United States Patent [19]

Watson

[11] Patent Number: 4,489,524

[45] Date of Patent: Dec. 25, 1984

[54] PORTABLE WELD GRINDING APPARATUS

[76] Inventor: Ronald E. Watson, R.R. 5, Box 299, Sullivan, Ind. 47882

[21] Appl. No.: 382,689

[22] Filed: May 28, 1982

[51] Int. Cl.[3] ..... B24B 23/00

[52] U.S. Cl. ..... 51/170 R; 51/241 LG

[58] Field of Search ..... 51/170 R, 170 PT, 241 LG, 51/178

[56] References Cited

U.S. PATENT DOCUMENTS

| | | | |
|---|---|---|---|
| 1,085,840 | 2/1914 | Apgar | 51/170 R |
| 1,751,174 | 3/1930 | Richards et al. | 51/170 PT |
| 1,823,371 | 9/1931 | Meissner | 51/170 PT |
| 1,995,421 | 3/1935 | Goldberg | 51/170 PT |
| 2,719,946 | 10/1955 | Riley . | |
| 2,808,521 | 10/1957 | K-F Scal . | |
| 2,867,039 | 1/1959 | Zach . | |
| 3,274,476 | 9/1966 | Wildum . | |
| 3,566,546 | 3/1971 | Lindmark . | |
| 3,823,455 | 7/1974 | McIlrath . | |

*Primary Examiner*—Roscoe V. Parker

*Attorney, Agent, or Firm*—Woodard, Weikart, Emhardt & Naughton

[57] ABSTRACT

A portable weld grinding apparatus for grinding welds which is powered by the direct current power source which also powers related welding equipment. The apparatus includes a portable housing which contains weld grinding gearing which rotates a shaft extending from the housing and a grinding wheel which is rotatably mounted to the shaft. An electric motor which is powered by direct current provides rotational movement to the grinding gearing and thereby to the grinding wheel. The device further has an electrical connection lug and ground clamp for electrically connecting the device with the direct current power source which powers related welding equipment.

1 Claim, 3 Drawing Figures

PORTABLE WELD GRINDING APPARATUS

BACKGROUND OF THE INVENTION

This invention relates in general to portable power tool apparata which are powered by a direct current power source which powers related equipment. More particularly the present invention relates to a portable weld grinding apparatus which is powered by a direct current power source which powers related welding equipment.

Portable power tools are frequently used at construction sites and particularly in high-rise construction. These portable power tools are either powered by alternating current power sources or by direct current batteries. In high-rise construction alternating current powered tools create a problem because alternating current power lines have to be strung up from the ground up to the height at which the power tools are being used. Since modern high-rise construction tends to involve very tall buildings, the length and plurality of alternating current power lines becomes excessive if the power tools are to be used in the upper areas of the structure.

Battery powered tools are a problem because the batteries have to be charged or recharged frequently and this interrupts construction causing downtime and increasing costs. Further, when a worker is in the midst of an operation such as, grinding a weld, he needs a reliable tool, and battery powered tools can run out of power at inappropriate times.

On current high-rise buildings one of the power tools that is most often used is a portable weld grinder. Due to the large amounts of structural metal that are used in high-rise construction, a great amount of welding is required. Since welding work also includes grinding down welds, the use of a portable weld grinder plays an important role. As welds are made they have to be continuously ground so that the welder can insure that the weld does not have any imperfections in it. By grinding the weld down as he builds the weld up the welder can continuously check for internal flaws and contamination. Thus the welder needs the capability to easily and quickly switch from welding to grinding.

A great deal of the welding that is done in high rise construction is electric arc welding which requires a direct current power source. Usually one direct current main power cable is strung up to the area where the welding is done and is connected to a main or central DC power unit. From this unit a plurality of direct current branch cables are run to the various welding sites. These direct current branch cables are used in the electric arc welding. In present arrangements a plurality of alternating current electrical cables have to be strung so as to power the alternating current weld grinders which are used to grind the welds. These alternating current electrical cables are an inconvenience and create a potential hazard at the construction site. It would be an improvement to these present arrangements to have power tools which operate on the power source that is used for the welding so that separate alternating current power lines do not have to be strung throughout the high-rise just for the power tools. This improvement will reduce the hazard and make the welding process much more convenient and efficient.

It would thus be beneficial to have power tools which would operate off of this direct current power source so that only one cable need be strung up to these high reaches of the high-rise construction. Ideally this cable would be the direct current power cable which also powers the electric arc welding. Once a layer of weld is applied, the welding device could be unhooked from the cable and then the power tools which are designed to operate on this direct current power source could be attached and subsequently used. There is less danger by this improved approach because the problems created by having many power cables strung about the structure are eliminated.

Unlike present arrangements, the present invention provides specifically for a portable weld grinding apparatus which takes advantage of the direct current power source which powers the related welding equipment. This apparatus is easily attached to the direct current cable which powers the welding equipment so that an operator can easily create a weld and then switch over to the weld grinding apparatus so as to grind the weld. The direct current power source which powers the related welding equipment can also be used to power an entire line of power tools which are used at construction sites. These power tools can be set up so as to run on this power source so that there is no need to string alternating current cables into the higher reaches of the construction site. As a result of the present invention only one cable need be strung up to the construction site and this cable can be the direct current cable which powers the related welding equipment.

The prior patented devices known to the inventor do not disclose any power tools which would be suitable for use with the direct current power source that powers the related welding equipment at a construction site. The following listed patents are believed to be representative of such prior patented devices:

| Patent Number | Patentee |
|---|---|
| 3,566,546 | Lindmark |
| 3,823,455 | McIlrath et al. |
| 3,274,476 | Wildum |
| 2,867,039 | Zach |
| 2,808,521 | K-F Scal |
| 2,719,946 | Riley |
| 1,085,840 | Apgar |

Lindmark shows an apparatus for grinding welded rail, but the device is by no means portable and would not be useable at a construction site in a hand held fashion. McIlrath shows a rail polishing machine. Wildum merely shows an article carrying belt. Zach shows a face shaving apparatus. K-F Scal shows a direct current power supply system. Riley shows a multiple phase transformer and dry disc rectifier assembly for resistance welding machines, and the like, as an example of the types of power sources which are used with electrical arc welding. Apgar shows a portable grinder, but this grinder is not hand held and would not be as portable as the power tool of the present invention nor is it specifically designed to be used with the direct current power source which powers related welding equipment at a construction site. These patents do not show any devices or apparatus which could be used as the present invention can be used with the power source which powers related welding equipment at a construction site.

SUMMARY OF THE INVENTION

In one embodiment of the present invention there is provided a portable weld grinding apparatus for grinding welds and which is powered by the direct current power source which powers related welding equipment. The apparatus comprises a portable housing, weld grinding means mounted to the housing and adapted for grinding the welds and motor means. The motor means are powered by the direct current power source and disposed in the housing and adapted for providing motion to the weld grinding means.

It is an object of this invention to provide an improved portable weld grinding apparatus powered by the direct current power source which powers related welding equipment.

It is a further object of this invention to provide improved power tools which are powered by a direct current power source which powers related equipment.

It is a further object of this invention to provide for an improved connector for connecting direct current power tools with the electrically energized electrode holder of the direct current power source which powers related welding equipment.

Related objects and advantages will become apparent as the description proceeds.

DESCRIPTION OF THE PREFERRED EMBODIMENT

Figure 1:
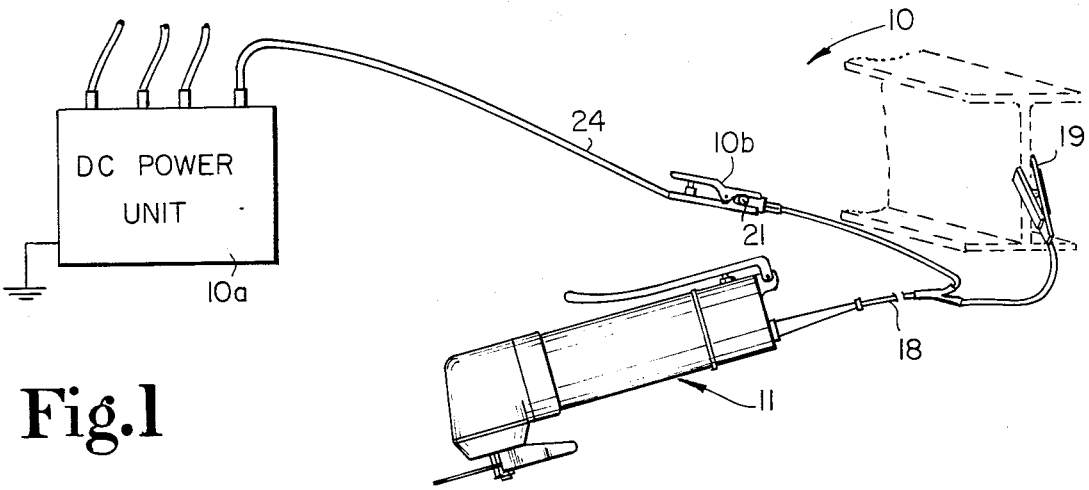
FIG. 1 is a perspective view of a portable weld grinding apparatus according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
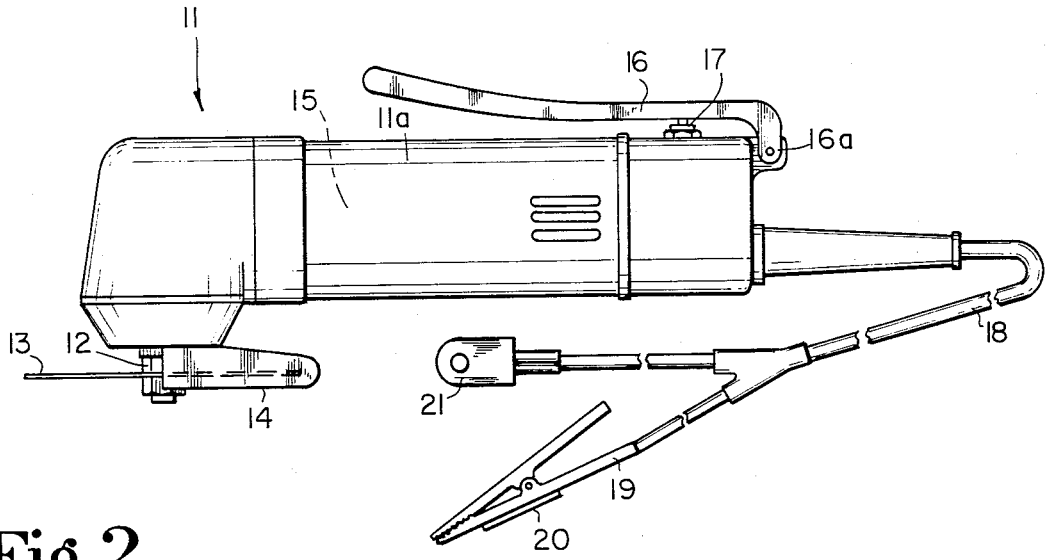
FIG. 2 is a perspective view of a portable weld grinder comprising a portion of the FIG. 1 apparatus.

Referring to FIGS. 1 and 2, there is illustrated a portable weld grinding apparatus 10. The apparatus includes a DC power unit 10*a*, an electrode holder 10*b* and a portable weld grinder 11 which is housed in a portable housing 11*a* which is small enough to be held in a person's hand.

Portable weld grinder 11 includes within housing 11*a* the necessary electric windings, components and gearing to convert a DC electrical input into rotary motion of shaft 12, as is believed known in the art. A grinding wheel 13, as is known in the art, is rotatably mounted to the grinding shaft 12. A safety enclosure 14 is provided so that when the user holds the apparatus with his hand there will not be any danger that he will be cut by the grinding wheel 13. While the maximum RPM rating of the grinder as well as its torque can be varied by varying the internal construction, it is to be understood that such variables should be fixed according to the use for the grinder.

The portable weld grinder 11 is driven by an electric motor 15 contained in portable housing 11*a*. This grinder motor has a field winding and an armature winding for direct current operation. It should be noted that a DC powered motor provides for more torque and does not get as hot as an AC powered motor. Also it does not reverse itself. Further, DC powered motors are cheaper to build, more reliable and generally better than the AC powered motors now used. DC powered equipment would also be safer than AC powered equipment because DC is not as dangerous as AC and there is less likelihood of electrocution.

The grinder is held in the operator's hand and is controlled by the operation of control handle 16. By squeezing handle 16 toward housing 11*a* so that it pivots at its pivot point 16*a* the two pole spring loaded ON/-OFF switch 17 is depressed and the grinder is turned on. Release of handle 16 releases switch 17 and the grinder is turned off.

Figure 3:
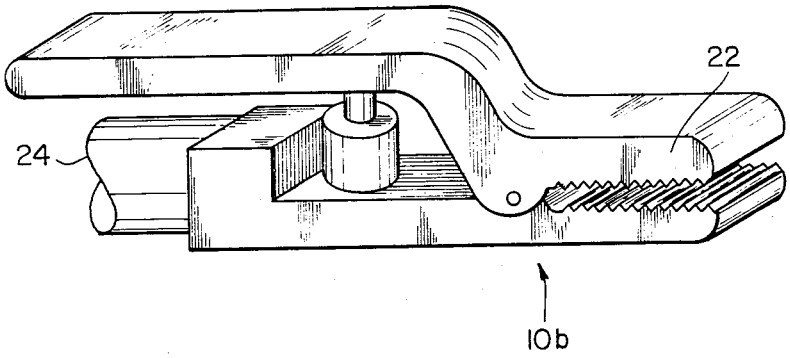
FIG. 3 is a perspective view of an electrode holder representative of that used with electric arc welding.

The power to the grinder is direct current electrical power which is provided by DC power unit 10*a* which powers the related welding equipment. The power is provided through electrical connection means and in the exemplary embodiment, the electrical connection means consist of a grinder power cable 18 which has a ground clamp 19 which can be easily clamped to an adjoining girder or any other ground which is nearby where the worker is operating the device so that the electrical connection is grounded. In case the worker does not have a place to clamp the device a ground clamp magnet 20 is provided so that the worker could secure the ground to a nearby metal beam by merely attaching it through the use of the magnet. The power cable also has a conducting lug 21 which is shaped so as to be received within the jaw portion 22 of the electrode holder 10*b* (see FIG. 3). The electrode holder is generally of the type known in the art, and which is typically used in resistance electrical arc welding. The electrode holder 10*b* is connected to the welding equipment's direct current power source, DC power unit 10*a*.

The electrode holder normally holds the welding rods and provides electrical power for the welding rods so that a weld will occur. When a worker is finished with welding he can release the electrode holder jaws 22 and release the welding rod and then attach these jaws about the conducting lug 21 so that the conducting lug 21 will be securely held within the electrode holder jaws 22. Thereafter, the direct current which is supplied by DC power unit 10*a* flows through the DC power cable 24 to the electrode holder 10*b*, then to lug 21, then to the power cable 18 and finally to the motor 15 of the grinder. This switching over from welding to weld grinding is quick, easy and efficient because it is accomplished by the release and attachment of two simple clamps. The worker merely clamps or magnetically attaches the ground clamp 9 to a ground and then completes the electrical connection by clamping the electrode holder 10*b* to the conducting lug 21.

Many portable power tools can be set up with motors which run on DC current. Similar connection means can then be provided as is shown for the portable weld grinder for attaching these power tools to the electrode holder of the weld power source so that these tools can also take advantage of a DC power source. Thus, this power source can be used for more than merely welding, such as for the powering of power tools. This concept and structure reduces the need for cumbersome and hazardous extra cables for alternating current.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In combination:

a direct current power unit designed and arranged for arc welding having a plurality of weld cables each fitted with an electrode clamp at its distal end, said clamps being of conventional construction including an interior conductive portion suitable to establish electrical continuity between said direct current power unit and any electrode held within said electrode clamp; and a hand-held, portable weld grinder including a weld grinding wheel and a direct current motor for providing rotary motion to the weld grinding wheel, said portable weld grinder including a dual-lead electrical cable connected at a first end to said portable weld grinder and including at the opposite end a pair of leads, the first lead of said pair being suitably adapted to be retained within said electrode clamp and the second lead being adapted to establish said ground connection.

* * * * *